US008851180B2

(12) United States Patent
Dykstra et al.

(10) Patent No.: US 8,851,180 B2
(45) Date of Patent: Oct. 7, 2014

(54) SELF-RELEASING PLUG FOR USE IN A SUBTERRANEAN WELL

(75) Inventors: Jason D. Dykstra, Carrollton, TX (US); John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 463 days.

(21) Appl. No.: 12/881,296

(22) Filed: Sep. 14, 2010

(65) Prior Publication Data

US 2012/0061088 A1 Mar. 15, 2012

(51) Int. Cl.
*E21B 34/08* (2006.01)

(52) U.S. Cl.
CPC ..... *E21B 34/08* (2013.01)
USPC ..... 166/317; 166/53; 166/318; 166/320; 166/329

(58) Field of Classification Search
USPC ..... 166/318, 319, 320, 373, 284, 376, 53, 166/329, 317
See application file for complete search history.

(56) References Cited

U.S. PATENT DOCUMENTS

| | | | | |
|---|---|---|---|---|
| 2,140,735 | A | 12/1938 | Clarke et al. | |
| 2,324,819 | A | 6/1941 | Butzbach | |
| 3,078,862 | A * | 2/1963 | Maly | 137/67 |
| 3,091,393 | A | 5/1963 | Sparrow | |
| 3,216,439 | A | 11/1965 | Manion | |
| 3,233,621 | A | 2/1966 | Manion | |
| 3,256,899 | A | 6/1966 | Dexter et al. | |
| 3,282,279 | A | 11/1966 | Manion | |
| 3,343,790 | A | 9/1967 | Bowles | |
| 3,461,897 | A | 8/1969 | Kwok | |
| 3,470,894 | A | 10/1969 | Rimmer | |
| 3,474,670 | A | 10/1969 | Rupert | |
| 3,489,009 | A | 1/1970 | Rimmer | |
| 3,515,160 | A | 6/1970 | Cohen | |
| 3,529,614 | A | 9/1970 | Nelson | |
| 3,537,466 | A | 11/1970 | Chapin | |
| 3,566,900 | A | 3/1971 | Black | |
| 3,586,104 | A | 6/1971 | Hyde | |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

Specification text, filed Apr. 11, 2011 U.S. Appl. No. 13/084,025, 37 pages.

(Continued)

*Primary Examiner* — Nicole Coy
(74) *Attorney, Agent, or Firm* — Smith IP Services, P.C.

(57) ABSTRACT

A flow control system for use in a subterranean well can include a flow chamber through which a fluid composition flows, and a plug which is released in response to an increase in a ratio of undesired fluid to desired fluid in the fluid composition. Another flow control system can include a flow chamber through which a fluid composition flows, a plug, and a structure which supports the plug, but which releases the plug in response to degrading of the structure by the fluid composition. Yet another flow control system can include a flow chamber through which a fluid composition flows, and a plug which is released in response to an increase in a velocity of the fluid composition in the flow chamber.

29 Claims, 9 Drawing Sheets

(56) References Cited

U.S. PATENT DOCUMENTS 3,598,137 A 8/1971 Glaze
3,620,238 A 11/1971 Kawabata et al.
3,670,753 A 6/1972 Healey
3,704,832 A 12/1972 Fix et al.
3,712,321 A 1/1973 Bauer
3,717,164 A 2/1973 Griffin
3,754,576 A 8/1973 Zetterstrom et al.
3,776,460 A 12/1973 Fichter
3,885,627 A * 5/1975 Berry et al. ..... 166/316
3,885,931 A 5/1975 Schaller
3,942,557 A 3/1976 Tsuchiya
4,029,127 A 6/1977 Thompson
4,082,169 A 4/1978 Bowles
4,127,173 A 11/1978 Watkins et al.
4,167,873 A 9/1979 Bahrton
4,187,909 A * 2/1980 Erbstoesser ..... 166/284
4,276,943 A 7/1981 Holmes
4,286,627 A 9/1981 Graf
4,291,395 A 9/1981 Holmes
4,307,653 A 12/1981 Goes et al.
4,323,991 A 4/1982 Holmes et al.
4,385,875 A 5/1983 Kanazawa
4,390,062 A 6/1983 Fox
4,418,721 A 12/1983 Holmes
4,518,013 A 5/1985 Lazarus
4,557,295 A 12/1985 Holmes
4,846,224 A 7/1989 Collins, Jr. et al.
4,895,582 A 1/1990 Bielefeldt
4,919,204 A 4/1990 Baker et al.
5,052,442 A 10/1991 Johannessen
5,165,450 A 11/1992 Marrelli
5,184,678 A 2/1993 Pechkov et al.
5,303,782 A 4/1994 Johannessen
5,455,804 A 10/1995 Holmes et al.
5,482,117 A 1/1996 Kolpak
5,484,016 A 1/1996 Surjaatmadja et al.
5,505,262 A 4/1996 Cobb
5,533,571 A 7/1996 Surjaatmadja et al.
5,570,744 A 11/1996 Weingarten et al.
5,893,383 A 4/1999 Facteau
6,015,011 A 1/2000 Hunter
6,078,471 A 6/2000 Fiske
6,109,372 A 8/2000 Dorel et al.
6,112,817 A 9/2000 Voll et al.
6,241,019 B1 6/2001 Davidson et al.
6,336,502 B1 1/2002 Surjaatmadja et al.
6,345,963 B1 2/2002 Thomin et al.
6,367,547 B1 4/2002 Towers et al.
6,371,210 B1 4/2002 Bode et al.
6,405,797 B2 6/2002 Davidson et al.
6,497,252 B1 12/2002 Kohler et al.
6,619,394 B2 9/2003 Soliman et al.
6,622,794 B2 9/2003 Zisk, Jr.
6,627,081 B1 9/2003 Hilditch et al.
6,644,412 B2 11/2003 Bode et al.
6,691,781 B2 2/2004 Grant et al.
6,719,048 B1 4/2004 Ramos et al.
6,851,473 B2 2/2005 Davidson
6,913,079 B2 7/2005 Tubel
6,976,507 B1 12/2005 Webb et al.
7,025,134 B2 4/2006 Byrd et al.
7,114,560 B2 10/2006 Nguyen et al.
7,185,706 B2 3/2007 Freyer
7,213,650 B2 5/2007 Lehman et al.
7,213,681 B2 5/2007 Birchak et al.
7,216,738 B2 5/2007 Birchak et al.
7,290,606 B2 11/2007 Coronado et al.
7,318,471 B2 1/2008 Rodney et al.
7,404,416 B2 7/2008 Schultz et al.
7,405,998 B2 7/2008 Webb et al.
7,409,999 B2 8/2008 Henriksen et al.
7,413,010 B2 8/2008 Blauch et al.
7,537,056 B2 5/2009 MacDougall
7,621,336 B2 11/2009 Badalamenti et al.
7,828,067 B2 11/2010 Scott et al.
7,857,050 B2 12/2010 Zazovsky et al.
8,127,856 B1 * 3/2012 Nish et al. ..... 166/376
8,235,128 B2 8/2012 Dykstra et al.
8,261,839 B2 9/2012 Fripp et al.
8,276,669 B2 10/2012 Dykstra et al.
8,302,696 B2 11/2012 Williams et al.
8,327,885 B2 12/2012 Dykstra et al.
8,356,668 B2 1/2013 Dykstra et al.
8,376,047 B2 2/2013 Dykstra et al.
8,381,817 B2 2/2013 Schultz et al.
8,430,130 B2 4/2013 Dykstra
8,439,117 B2 5/2013 Schultz et al.
8,453,745 B2 6/2013 Schultz et al.
8,464,759 B2 6/2013 Dykstra et al.
8,479,831 B2 7/2013 Dykstra et al.
8,517,105 B2 8/2013 Schultz et al.
8,517,106 B2 8/2013 Schultz et al.
8,517,107 B2 8/2013 Schultz et al.
8,517,108 B2 8/2013 Schultz et al.
8,555,924 B2 10/2013 Faram et al.
8,555,975 B2 10/2013 Dykstra et al.
8,584,762 B2 11/2013 Fripp et al.
8,602,106 B2 12/2013 Lopez
8,657,017 B2 2/2014 Dykstra et al.
2006/0131033 A1 6/2006 Bode et al.
2007/0028977 A1 2/2007 Goulet
2007/0045038 A1 3/2007 Han et al.
2007/0246407 A1 10/2007 Richards et al.
2007/0256828 A1 11/2007 Birchak et al.
2008/0035350 A1 * 2/2008 Henriksen et al. ..... 166/313
2008/0041580 A1 2/2008 Freyer et al.
2008/0041581 A1 2/2008 Richards
2008/0041582 A1 2/2008 Saetre et al.
2008/0041588 A1 2/2008 Richards et al.
2008/0149323 A1 6/2008 O'Malley et al.
2008/0169099 A1 7/2008 Pensgaard
2008/0236839 A1 10/2008 Oddie
2008/0261295 A1 10/2008 Butler et al.
2008/0283238 A1 11/2008 Richards et al.
2008/0314590 A1 12/2008 Patel
2009/0000787 A1 1/2009 Hill et al.
2009/0008088 A1 1/2009 Schultz et al.
2009/0008090 A1 1/2009 Schultz et al.
2009/0009297 A1 1/2009 Shinohara et al.
2009/0009333 A1 1/2009 Bhogal et al.
2009/0009336 A1 1/2009 Ishikawa
2009/0009412 A1 1/2009 Warther
2009/0009437 A1 1/2009 Hwang et al.
2009/0009445 A1 1/2009 Lee
2009/0009447 A1 1/2009 Naka et al.
2009/0065197 A1 3/2009 Eslinger
2009/0078427 A1 3/2009 Patel
2009/0078428 A1 3/2009 Ali
2009/0101352 A1 4/2009 Coronado et al.
2009/0101354 A1 4/2009 Holmes et al.
2009/0120647 A1 5/2009 Turick et al.
2009/0133869 A1 5/2009 Clem
2009/0151925 A1 6/2009 Richards et al.
2009/0159282 A1 6/2009 Webb et al.
2009/0250224 A1 10/2009 Wright et al.
2009/0277639 A1 11/2009 Schultz et al.
2009/0277650 A1 11/2009 Casciaro et al.
2011/0042091 A1 2/2011 Dykstra et al.
2011/0042092 A1 2/2011 Fripp et al.
2011/0079384 A1 4/2011 Russell et al.
2011/0139453 A1 6/2011 Schultz et al.
2011/0186300 A1 8/2011 Dykstra et al.
2011/0198097 A1 8/2011 Moen
2011/0214876 A1 9/2011 Dykstra et al.
2011/0297384 A1 12/2011 Fripp et al.
2011/0297385 A1 12/2011 Dykstra et al.
2011/0308806 A9 12/2011 Dykstra et al.
2012/0048563 A1 3/2012 Holderman
2012/0060624 A1 3/2012 Dykstra
2012/0061088 A1 3/2012 Dykstra et al.
2012/0111577 A1 5/2012 Dykstra et al.
2012/0125626 A1 5/2012 Constantine
2012/0145385 A1 6/2012 Lopez
2012/0181037 A1 7/2012 Holderman

(56) References Cited

U.S. PATENT DOCUMENTS

| | | | |
|---|---|---|---|
| 2012/0211243 | A1 | 8/2012 | Dykstra et al. |
| 2012/0227813 | A1 | 9/2012 | Meek et al. |
| 2012/0234557 | A1 | 9/2012 | Dykstra et al. |
| 2012/0255351 | A1 | 10/2012 | Dykstra |
| 2012/0255739 | A1 | 10/2012 | Fripp et al. |
| 2012/0255740 | A1 | 10/2012 | Fripp et al. |
| 2012/0292017 | A1 | 11/2012 | Schultz et al. |
| 2012/0292018 | A1 | 11/2012 | Schultz et al. |
| 2012/0292019 | A1 | 11/2012 | Schultz et al. |
| 2012/0292020 | A1 | 11/2012 | Schultz et al. |
| 2012/0292033 | A1 | 11/2012 | Schultz et al. |
| 2012/0292116 | A1 | 11/2012 | Schultz et al. |
| 2012/0305243 | A1 | 12/2012 | Hallundbaek et al. |
| 2013/0020088 | A1 | 1/2013 | Dyer et al. |
| 2013/0048299 | A1 | 2/2013 | Fripp et al. |
| 2013/0075107 | A1 | 3/2013 | Dykstra et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0153238 | A1 | 6/2013 | Fripp et al. |
| 2013/0180727 | A1 | 7/2013 | Dykstra et al. |
| 2013/0186633 | A1 | 7/2013 | Kitzman |
| 2013/0186634 | A1 | 7/2013 | Fripp et al. |
| 2013/0255960 | A1 | 10/2013 | Fripp et al. |
| 2013/0277066 | A1 | 10/2013 | Fripp et al. |
| 2013/0299198 | A1 | 11/2013 | Gano et al. |
| 2014/0041731 | A1 | 2/2014 | Fripp et al. |
| 2014/0048280 | A9 | 2/2014 | Fripp et al. |
| 2014/0048282 | A1 | 2/2014 | Dykstra et al. |

FOREIGN PATENT DOCUMENTS

| | | | |
|---|---|---|---|
| EP | 2146049 | A2 | 1/2010 |
| EP | 2146049 | A2 | 7/2010 |
| WO | 0214647 | A1 | 2/2002 |
| WO | 03062597 | A1 | 7/2003 |
| WO | 2004033063 | A2 | 4/2004 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | 2012033638 | A2 | 3/2012 |

OTHER PUBLICATIONS

Drawings, filed Apr. 11, 2011 U.S. Appl. No. 13/084,025, 13 figures, 8 pages.
Office Action issued Mar. 7, 2012 for U.S. Appl. No. 12/792,117, 40 pages.
Office Action issued Mar. 8, 2012 for U.S. Appl. No. 12/792,146, 26 pages.
International Search Report with Written Opinion issued Jan. 5, 2012 for PCT Patent Application No. PCT/US11/047925, 9 pages.
Stanley W. Angrist; "Fluid Control Devices", published Dec. 1964, 5 pages.
Lee Precision Micro Hydraulics, Lee Restrictor Selector product brochure; Jan. 2011, 9 pages.
Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.
Tesar, V.; Sampling by Fluidics and Microfluidics; Acta Polytechnica; Feb. 2002; pp. 41-49; vol. 42; The University of Sheffield; Sheffield, UK.
Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.
International Search Report and Written Opinion issued Mar. 25, 2011 for International Patent Application Serial No. PCT/US2010/044409, 9 pages.
International Search Report and Written Opinion issued Mar. 31, 2011 for International Patent Application Serial No. PCT/US2010/044421, 9 pages.
Search Report issued Apr. 17, 2012 for International Application No. PCT/US11/50255, 5 pages.
Written Opinion issued Apr. 17, 2012 for International Application No. PCT/US11/50255, 4 pages.
International Search Report with Written Opinion issued Apr. 17, 2012 for PCT Patent Application No. PCT/US11/050255, 9 pages.
International Search Report with Written Opinion issued Mar. 26, 2012 for PCT Patent Application No. PCT/US11/048986, 9 pages.
Office Action issued May 24, 2012 for U.S. Appl. No. 13/430,507, 17 pages.
Specification and Drawings for U.S. Appl. No. 13/495,078, filed Jun. 13, 2012, 39 pages.
Office Action issued May 24, 2012 for U.S. Appl. No. 12/869,836, 60 pages.
Office Action issued Jun. 27, 2011 for U.S. Appl. No. 12/791,993, 17 pages.
Office Action issued Jun. 19, 2012 for U.S. Appl. No. 13/111,169, 17 pages.
Joseph M. Kirchner, "Fluid Amplifiers", 1996, 6 pages, McGraw-Hill, New York.
Joseph M. Kirchner, et al., "Design Theory of Fluidic Components", 1975, 9 pages, Academic Press, New York.
Microsoft Corporation, "Fluidics" article, Microsoft Encarta Online Encyclopedia, copyright 1997-2009, 1 page, USA.
The Lee Company Technical Center, "Technical Hydraulic Handbook" 11th Edition, copyright 1971-2009, 7 pages, Connecticut.
Specification and Drawings for U.S. Appl. No. 12/792,095, filed Jun. 2, 2010, 29 pages.
Specification and Drawings for U.S. Appl. No. 10/650,186, filed Aug. 28, 2003, 16 pages.
Apparatus and Method of Inducing Fluidic Oscillation in a Rotating Cleaning Nozzle, ip.com, dated Apr. 24, 2007, 3 pages.
Office Action issued Oct. 26, 2011 for U.S. Appl. No. 13/111,169, 28 pages.
Office Action issued Nov. 2, 2011 for U.S. Appl. No. 12/792,146, 34 pages.
Office Action issued Nov. 3, 2011 for U.S. Appl. No. 13/111,169, 16 pages.
Office Action issued Nov. 2, 2011 for U.S. Appl. No. 12/792,117, 35 pages.
Office Action issued Oct. 27, 2011 for U.S. Appl. No. 12/791,993, 15 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
Advisory Action issued Aug. 30, 2012 for U.S. Appl. No. 13/111,169, 15 pages.
Office Action issued Sep. 10, 2012 for U.S. Appl. No. 12/792,095, 59 pages.
Specification and Drawings for U.S. Appl. No. 12/542,695, filed Aug. 18, 2009, 32 pages.
Specification and Drawings for U.S. Appl. No. 13/659,323, filed Oct. 24, 2012, 81 pages.
Specification and Drawings for U.S. Appl. No. 13/659,375, filed Oct. 24, 2012, 54 pages.
Specification and Drawings for U.S. Appl. No. 13/659,435, filed Oct. 24, 2012, 37 pages.
International Search Report with Written Opinion dated Aug. 31, 2012 for PCT Patent Application No. PCT/US11/060606, 10 pages.
Office Action issued Sep. 19, 2012 for U.S. Appl. No. 12/879,846, 78 pages.
Office Action issued Sep. 19, 2012 for US Patent Application No. 113/495,078, 29 pages.

(56) References Cited

OTHER PUBLICATIONS

Search Report and Written Opinion issued Oct. 19, 2012 for International Application No. PCT/US12/30641, 9 pages.
Office Action issued Apr. 23, 2013 for U.S. Appl. No. 13/659,323, 65 pages.
Office Action issued Apr. 24, 2013 for U.S. Appl. No. 13/633,693, 33 pages.
Office Action issued Apr. 26, 2013 for U.S. Appl. No. 13/678,489, 51 pages.
Office Action issued May 8, 2013 for U.S. Appl. No. 12/792,095, 14 pages.
Office Action Issued Jan. 17, 2013 for U.S. Appl. No. 12/879,846, 26 pages.
Office Action Issued Jan. 16, 2013 for U.S. Appl. No. 13/495,078, 24 pages.
Office Action issued Jan. 22, 2013 for U.S. Appl. No. 13/633,693, 30 pages.
Office Action issued Feb. 21, 2013 for U.S. Appl. No. 12/792,095, 26 pages.
Office Action issued Mar. 4, 2013 for U.S. Appl. No. 13/678,497, 26 pages.
Office Action issued Mar. 4, 2013 for U.S. Appl. No. 13/659,375, 24 pages.
Advisory Action issued Mar. 14, 2013 for U.S. Appl. No. 13/495,078, 14 pages.
Office Action issued Mar. 15, 2013 for U.S. Appl. No. 13/659,435, 20 pages.
Office Action issued Mar. 11, 2014 for U.S. Appl. No. 13/351,035, 120 pages.
Office Action issued Aug. 7, 2013 for U.S. Appl. No. 13/659,323, 37 pages.
Office Action issued Aug. 7, 2013 for U.S. Appl. No. 13/678,489, 24 pages.
Office Action issued Aug. 20, 2013 for U.S. Appl. No. 13/659,375, 24 pages.
Office Action issued Aug. 12, 2013 for U.S. Appl. No. 13/084,025, 93 pages.
Office Action issued Oct. 11, 2013 for U.S. Appl. No. 12/792,095, 18 pages.
Office Action issued Nov. 5, 2013 for U.S. Appl. No. 13/084,025, 23 pages.
Advisory Action issued Dec. 27, 2013 for U.S. Appl. No. 12/792,095, 8 pages.
Office Action issued May 6, 2014 for Canadian Patent Application No. 2,812,138, 3 pages.

* cited by examiner

SELF-RELEASING PLUG FOR USE IN A SUBTERRANEAN WELL

BACKGROUND

This disclosure relates generally to equipment utilized and operations performed in conjunction with a subterranean well and, in an example described below, more particularly provides a flow control system with a self-releasing plug.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil and/or gas production, balancing production among zones, etc.

In an injection well, it is typically desirable to evenly inject water, steam, gas, etc., into multiple zones, so that hydrocarbons are displaced evenly through an earth formation, without the injected fluid prematurely breaking through to a production wellbore. Thus, the ability to regulate flow of fluids from a wellbore into an earth formation can also be beneficial for injection wells.

Therefore, it will be appreciated that advancements in the art of controlling fluid flow in a well would be desirable in the circumstances mentioned above, and such advancements would also be beneficial in a wide variety of other circumstances.

SUMMARY

In the disclosure below, a flow control system is provided which brings improvements to the art of regulating fluid flow in wells. One example is described below in which a flow control system is used in conjunction with a variable flow resistance system. Another example is described below in which a flow control system is used in conjunction with an inflow control device.

In one aspect, the disclosure provides to the art a flow control system for use in a subterranean well. The system can include a flow chamber through which a fluid composition flows, and a plug which is released in response to an increase in a ratio of undesired fluid to desired fluid in the fluid composition.

In another aspect, a flow control system described below can include a flow chamber through which a fluid composition flows, a plug and a structure which supports the plug, but which releases the plug in response to degrading of the structure by the fluid composition.

In yet another aspect, a flow control system can include a flow chamber through which a fluid composition flows, and a plug which is released in response to an increase in a velocity of the fluid composition in the flow chamber.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
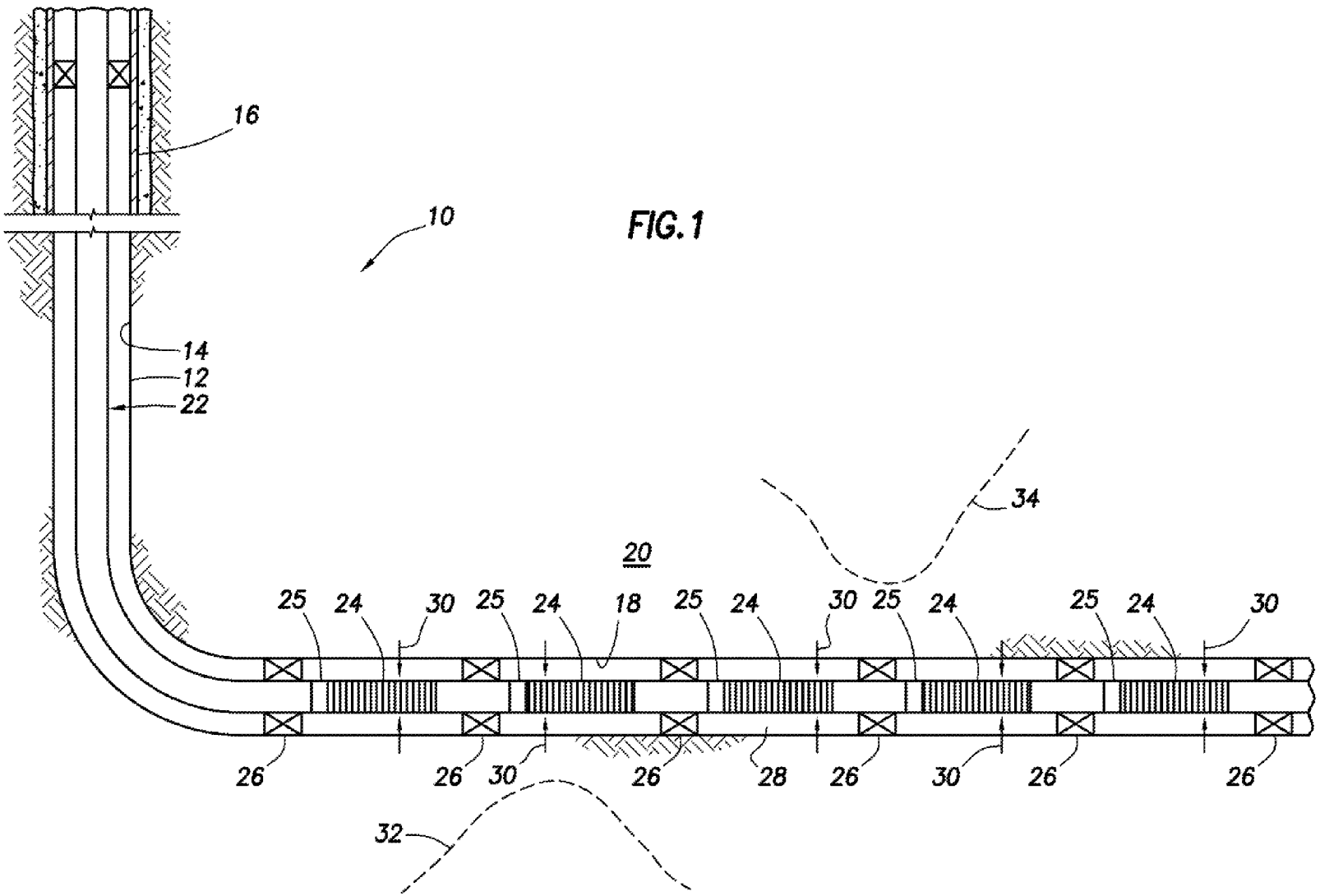
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), and/or increasing resistance to flow if a fluid viscosity decreases below a selected level (e.g., to thereby restrict flow of an undesired fluid, such as water or gas, in an oil producing well).

As used herein, the term "viscosity" is used to indicate any of the rheological properties including kinematic viscosity, yield strength, viscoplasticity, surface tension, wettability, etc.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid, condensate and/or gaseous phases are included within the scope of that term.

Figure 2:
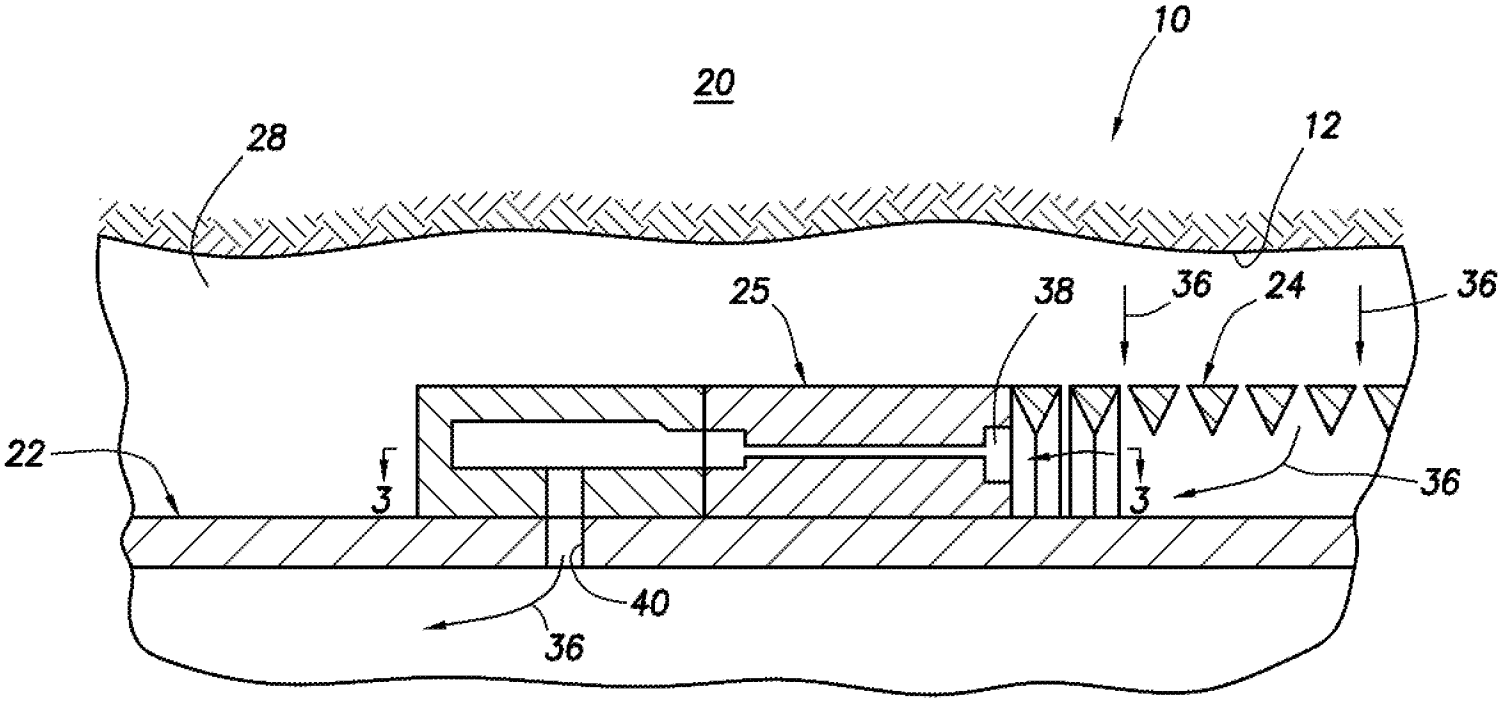
FIG. 2 is an enlarged scale schematic cross-sectional view of a well screen and a variable flow resistance system which may be used in the well system of FIG. 1.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example the system can include various passages and devices for performing various functions, as described more fully below. In addition, the system 25 preferably at least partially extends circumferentially about the tubular string 22, and/or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3B:
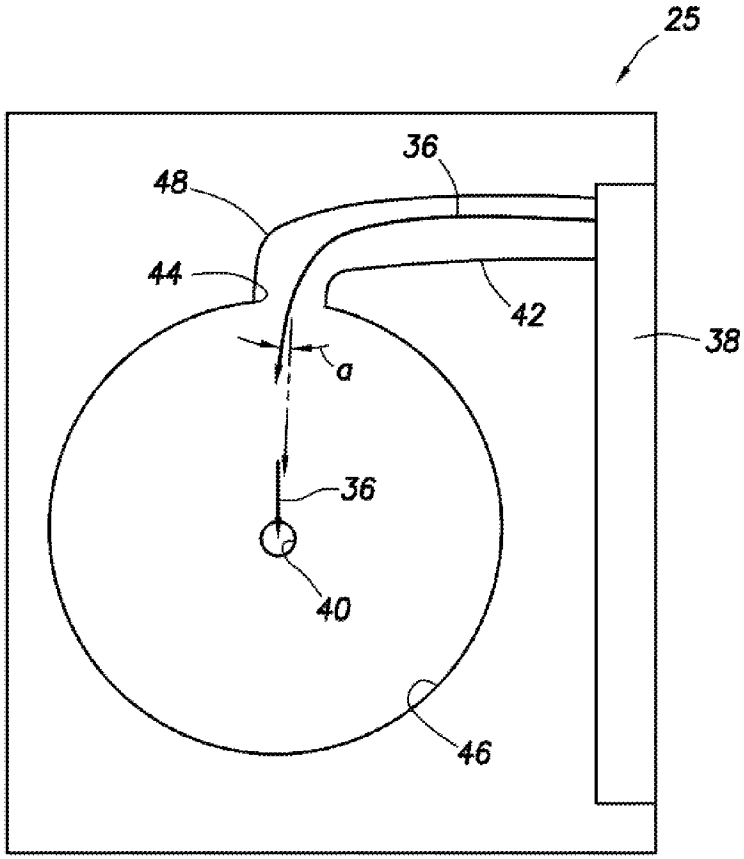
FIGS. 3A & B are schematic "unrolled" plan views of one configuration of the variable flow resistance system, taken along line 3-3 of FIG. 2.
Figure 3A:
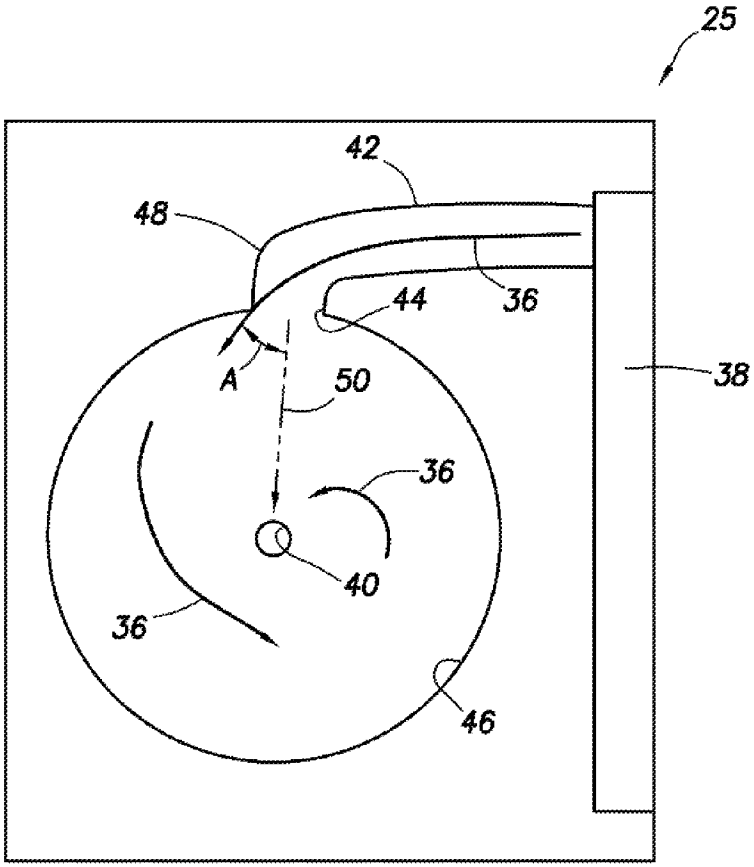

Referring additionally now to FIGS. 3A & B, a more detailed cross-sectional view of one example of the system 25 is representatively illustrated. The system 25 is depicted in FIGS. 3A & B as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition.

In FIG. 3A, a relatively high velocity and/or low viscosity fluid composition 36 flows through a flow passage 42 from the system inlet 38 to an inlet 44 of a flow chamber 46. The flow passage 42 has an abrupt change in direction 48 just upstream of the inlet 44. The abrupt change in direction 48 is illustrated as a relatively small radius ninety degree curve in the flow passage 42, but other types of direction changes may be used, if desired.

As depicted in FIG. 3A, the chamber 46 is generally cylindrical-shaped and, prior to the abrupt change in direction 48, the flow passage 42 directs the fluid composition 36 to flow generally tangentially relative to the chamber. Because of the relatively high velocity and/or low viscosity of the fluid composition 36, it does not closely follow the abrupt change in direction 48, but instead continues into the chamber 46 via the inlet 44 in a direction which is substantially angled (see angle A in FIG. 3A) relative to a straight direction 50 from the inlet 44 to the outlet 40. The fluid composition 36 will, thus, flow circuitously from the inlet 44 to the outlet 40, eventually spiraling inward to the outlet.

In contrast, a relatively low velocity and/or high viscosity fluid composition 36 flows through the flow passage 42 to the chamber inlet 44 in FIG. 3B. Note that the fluid composition 36 in this example more closely follows the abrupt change in direction 48 of the flow passage 42 and, therefore, flows through the inlet 44 into the chamber 46 in a direction which is only slightly angled (see angle a in FIG. 3B) relative to the straight direction 50 from the inlet 44 to the outlet 40. The fluid composition 36 in this example will, thus, flow much more directly from the inlet 44 to the outlet 40.

Note that, as depicted in FIG. 3B, the fluid composition 36 also exits the chamber 46 via the outlet 40 in a direction which is only slightly angled relative to the straight direction 50 from the inlet 44 to the outlet 40. Thus, the fluid composition 36 exits the chamber 46 in a direction which changes based on velocity, viscosity, and/or the ratio of desired fluid to undesired fluid in the fluid composition.

It will be appreciated that the much more circuitous flow path taken by the fluid composition 36 in the example of FIG. 3A consumes more of the fluid composition's energy at the same flow rate and, thus, results in more resistance to flow, as compared to the much more direct flow path taken by the fluid composition in the example of FIG. 3B. If oil is a desired fluid, and water and/or gas are undesired fluids, then it will be appreciated that the variable flow resistance system 25 of FIGS. 3A & B will provide less resistance to flow of the fluid composition 36 when it has an increased ratio of desired to undesired fluid therein, and will provide greater resistance to flow when the fluid composition has a decreased ratio of desired to undesired fluid therein.

Since the chamber 46 has a generally cylindrical shape as depicted in the examples of FIGS. 3A & B, the straight direction 50 from the inlet 44 to the outlet 40 is in a radial direction. The flow passage 42 upstream of the abrupt change in direction 48 is directed generally tangential relative to the chamber 46 (i.e., perpendicular to a line extending radially from the center of the chamber). However, the chamber 46 is not necessarily cylindrical-shaped and the straight direction 50 from the inlet 44 to the outlet 40 is not necessarily in a radial direction, in keeping with the principles of this disclosure.

Since the chamber 46 in this example has a cylindrical shape with a central outlet 40, and the fluid composition 36 (at least in FIG. 3A) spirals about the chamber, increasing in velocity as it nears the outlet, driven by a pressure differential from the inlet 44 to the outlet, the chamber may be referred to as a "vortex" chamber.

Figure 4B:
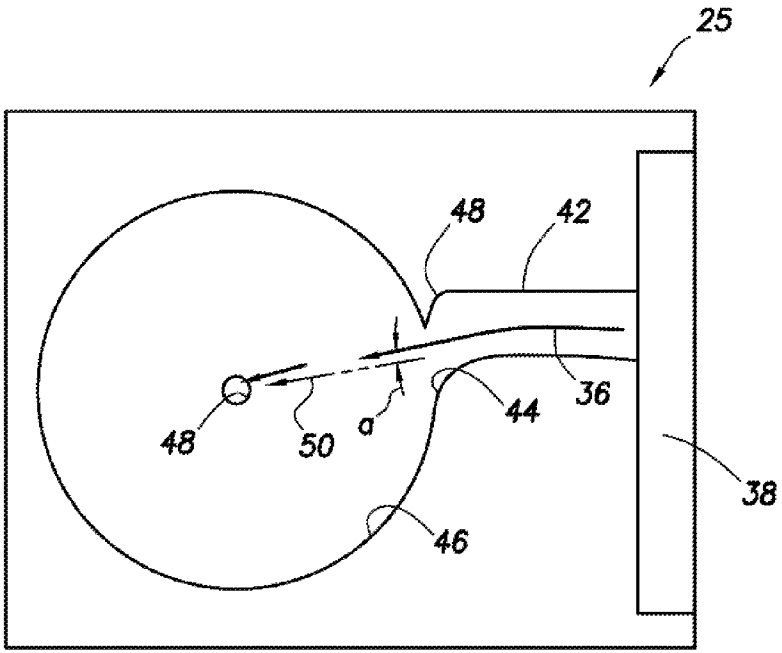
FIGS. 4A & B are schematic plan views of another configuration of the variable flow resistance system.
Figure 4A:
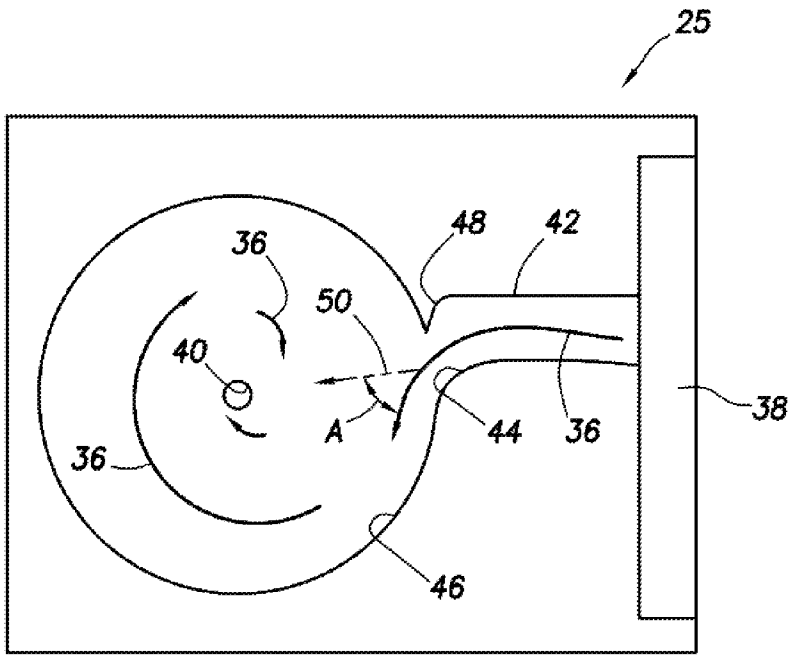

Referring additionally now to FIGS. 4A & B, another configuration of the variable flow resistance system 25 is representatively illustrated. The configuration of FIGS. 4A & B is similar in many respects to the configuration of FIGS. 3A & B, but differs at least in that the flow passage 42 extends much more in a radial direction relative to the chamber 46 upstream of the abrupt change in direction 48, and the abrupt change in direction influences the fluid composition 36 to flow away from the straight direction 50 from the inlet 44 to the outlet 40.

In FIG. 4A, a relatively high viscosity and/or low velocity fluid composition 36 is influenced by the abrupt change in direction 48 to flow into the chamber 46 in a direction away from the straight direction 50 (e.g., at a relatively large angle A to the straight direction). Thus, the fluid composition 36 will flow circuitously about the chamber 46 prior to exiting via the outlet 40.

Note that this is the opposite of the situation described above for FIG. 3B, in which the relatively high viscosity and/or low velocity fluid composition 36 enters the chamber 46 via the inlet 44 in a direction which is only slightly angled relative to the straight direction 50 from the inlet to the outlet 40. However, a similarity of the FIGS. 3B & 4A configurations is that the fluid composition 36 tends to change direction with the abrupt change in direction 48 in the flow passage 42.

In contrast, a relatively high velocity and/or low viscosity fluid composition 36 flows through the flow passage 42 to the chamber inlet 44 in FIG. 4B. Note that the fluid composition 36 in this example does not closely follow the abrupt change in direction 48 of the flow passage 42 and, therefore, flows through the inlet 44 into the chamber 46 in a direction which is angled only slightly relative to the straight direction 50 from the inlet 44 to the outlet 40. The fluid composition 36 in this example will, thus, flow much more directly from the inlet 44 to the outlet 40.

It will be appreciated that the much more circuitous flow path taken by the fluid composition 36 in the example of FIG. 4A consumes more of the fluid composition's energy at the same flow rate and, thus, results in more resistance to flow, as compared to the much more direct flow path taken by the fluid composition in the example of FIG. 4B. If gas or steam is a desired fluid, and water and/or oil are undesired fluids, then it will be appreciated that the variable flow resistance system 25 of FIGS. 4A & B will provide less resistance to flow of the fluid composition 36 when it has an increased ratio of desired to undesired fluid therein, and will provide greater resistance to flow when the fluid composition has a decreased ratio of desired to undesired fluid therein.

Figure 5B:
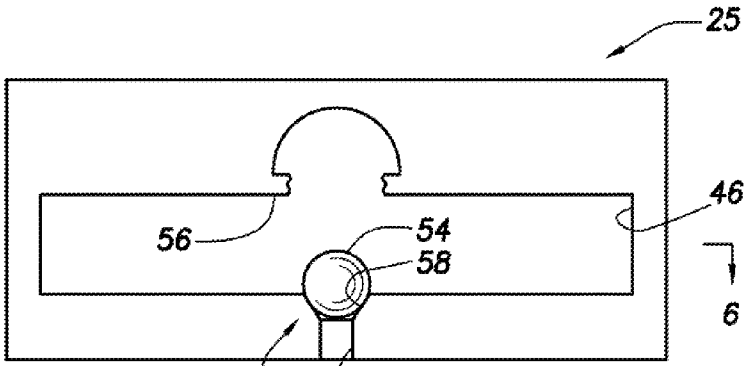
FIGS. 5A-C are schematic plan views of another configuration of the variable flow resistance system.
Figure 5A:
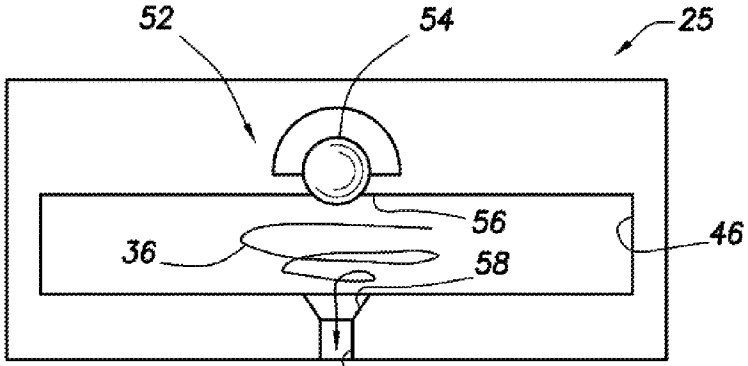

Referring additionally now to FIGS. 5A & B, another configuration of the variable flow resistance system 25 is representatively illustrated. In this configuration, a flow control system 52 is used which shares some of the elements of the variable flow resistance system 25. The flow control system 52 desirably shuts off flow through the variable flow resistance system 25 when an unacceptably high ratio of undesired fluid to desired fluid flows through the chamber 46, when a particular undesired fluid flows through the chamber and/or when the fluid composition 36 flows through the chamber at a velocity which is above a predetermined acceptable level.

In FIG. 5A, it may be seen that the flow control system 25 includes a plug 54 in the form of a ball. Other types of plugs (such as cylindrical, flat, or otherwise shaped plugs, plugs with seals thereon, etc.) may be used, if desired.

The plug 54 is retained in a central position relative to the chamber 46 by means of a support structure 56. The structure 56 releasably supports the plug 54. The structure 56 may be made of a material which relatively quickly corrodes when contacted by a particular undesired fluid (for example, the structure could be made of cobalt, which corrodes when in contact with salt water). The structure 56 may be made of a material which relatively quickly erodes when a high velocity fluid impinges on the material (for example, the structure could be made of aluminum, etc.). However, it should be understood that any material may be used for the structure 56 in keeping with the principles of this disclosure.

In FIG. 5B, it may be seen that the structure 56 has been degraded by exposure to a relatively high velocity fluid composition 36 in the chamber 46, by an undesired fluid in the fluid composition, and/or by an increased ratio of undesired to desired fluids in the fluid composition. The plug 54 has been released from the degraded structure 56 and now sealingly engages a seat 58 located somewhat upstream of the outlet 40.

Flow through the chamber 46 is now prevented by the sealing engagement between the plug 54 and the seat 58. It will be appreciated that this flow prevention is beneficial, in that it prevents production of the undesired fluid through the chamber 46, it prevents production of unacceptably high velocity fluid through the chamber, etc.

In circumstances in which unacceptably high levels of undesired fluid are being produced through the variable flow resistance system 25, it may be more beneficial to completely shut off flow through the chamber 46, rather than merely increase the resistance to flow through the chamber. The flow control system 52 accomplishes this result automatically, without the need for human intervention, in response to sustained flow of undesired fluid through the chamber 46, in response to sustained high velocity flow through the chamber, etc.

Of course, the material of the structure 56 can be conveniently selected and dimensioned to cause release of the plug 54 in response to certain levels of undesired fluids, high velocity flow, etc., and/or exposure of the structure to the undesired fluids and/or high velocity flow for certain periods of time. For example, the structure 56 could be configured to release the plug 54 only after a certain number of days or weeks of exposure to a certain undesired fluid, or to an unacceptably high velocity flow.

Figure 5C:
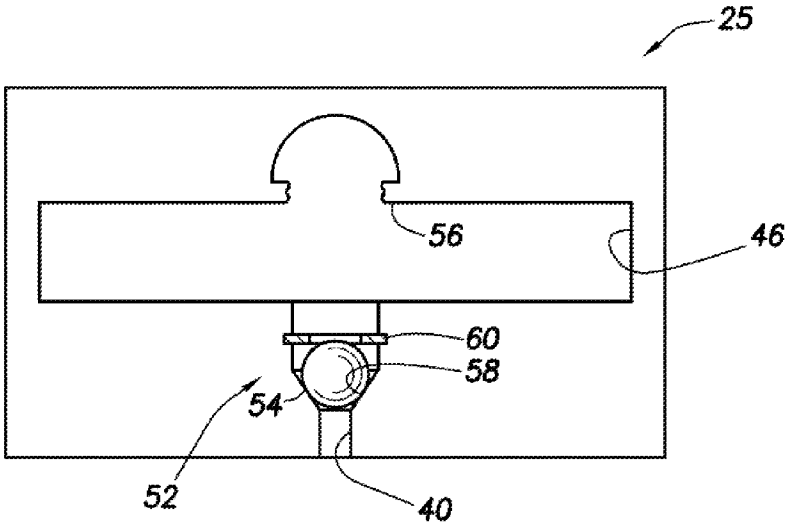

In FIG. 5C, the flow control system 52 is provided with a latch device 60 which prevents the plug 54 from displacing away from the seat, or back into the chamber 46. The latch device 60 can also be configured to seal against the plug 54, so that reverse flow (e.g., from the outlet 40 to the inlet 44) is prevented.

Figure 6:
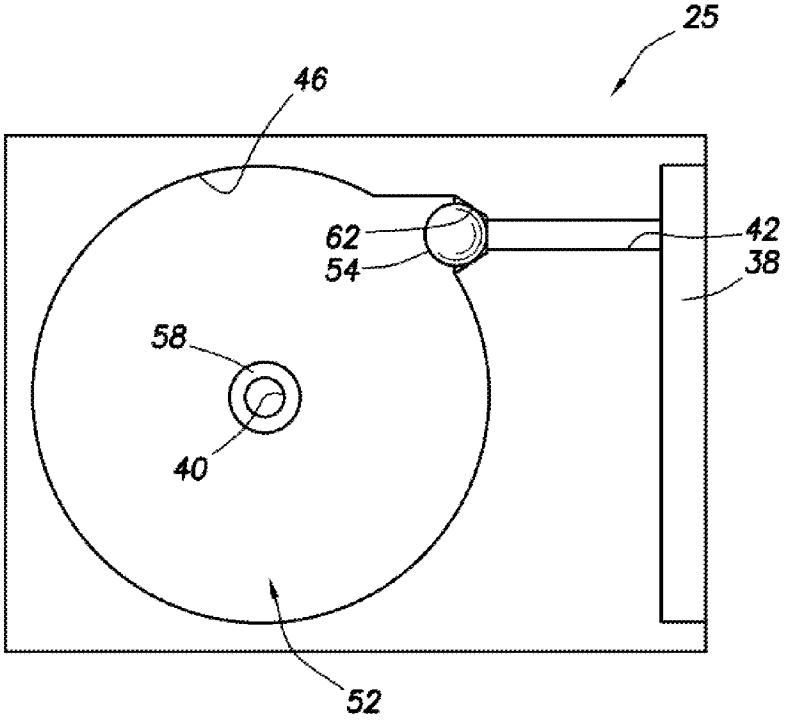
FIG. 6 is a schematic plan view of yet another configuration of the variable flow resistance system.

Referring additionally now to FIG. 6, the system 25 is representatively illustrated after the plug 54 has been released (as in FIG. 5B), but with a pressure differential being applied from the outlet 40 to the inlet 38. This would be the case if reverse flow through the chamber 46 were to be attempted.

As depicted in FIG. 6, another seat 62 can be provided for sealing engagement with the plug 54, to thereby prevent reverse flow through the chamber 46 after the plug has been released. The passage 42 can also be dimensioned to prevent the plug 54 from being displaced out of the chamber 46.

Figure 7:
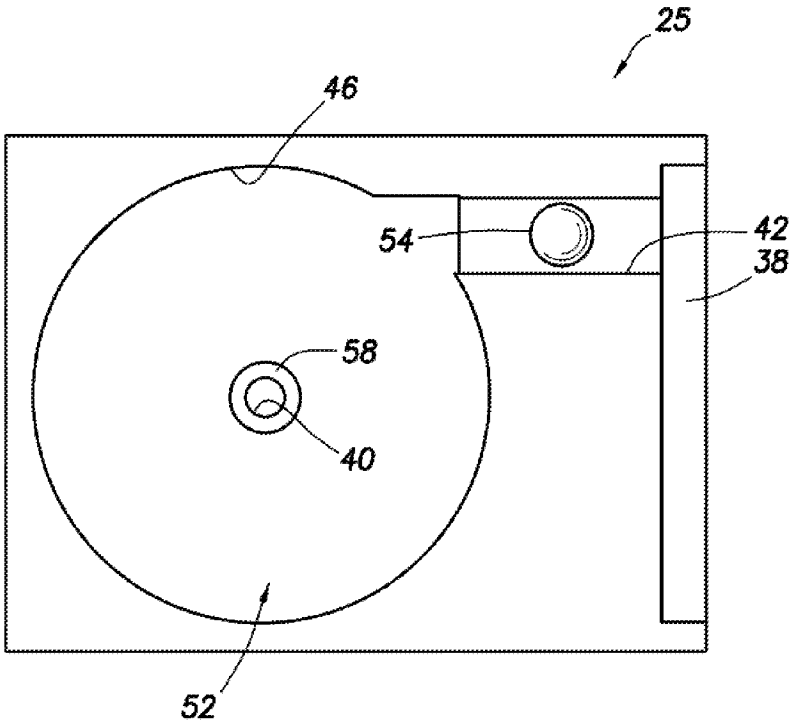
FIG. 7 is a schematic plan views of another configuration of the variable flow resistance system.

Referring additionally now to FIG. 7, another configuration is representatively illustrated. In this configuration, the passage 42 is dimensioned so that the plug 54 can be displaced out of the chamber 46. This configuration may be useful in circumstances in which it is desired to be able to restore flow through the chamber 46, even after the plug 54 has been released. Flow through the chamber 46 could be restored by using reverse flow through the chamber to displace the plug 54 out of the chamber.

Figure 8:
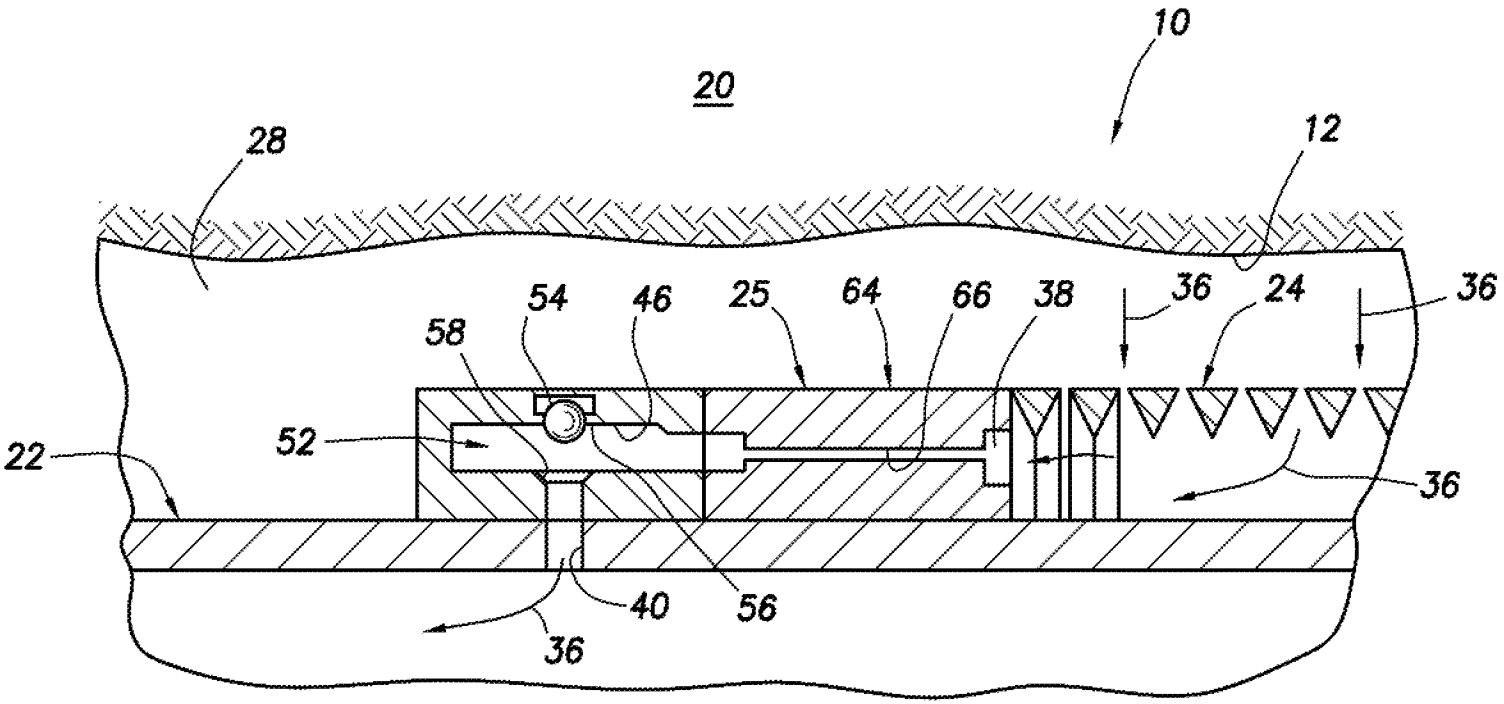
FIG. 8 is a schematic cross-sectional view of a well screen and an inflow control device which may be used in the well system of FIG. 1.

Referring additionally now to FIG. 8, another configuration is representatively illustrated in which the flow control system 52 is used in conjunction with an inflow control device 64. Instead of the variable flow resistance system 25, the inflow control device 64 includes a fixed flow restrictor 66 which restricts flow of the fluid composition 36 into the tubular string 22.

The configuration of FIG. 8 operates in a manner similar to that described above for the configurations of FIGS. 5A-7. However, the chamber 46 is not necessarily a "vortex" chamber. The structure 56 can release the plug 54 for sealing engagement with the seat 58 to prevent flow through the chamber 46 when a particular undesired fluid is flowed through the chamber, when an increased ratio of undesired to desired fluids is in the fluid composition 36, etc.

Figure 9A:
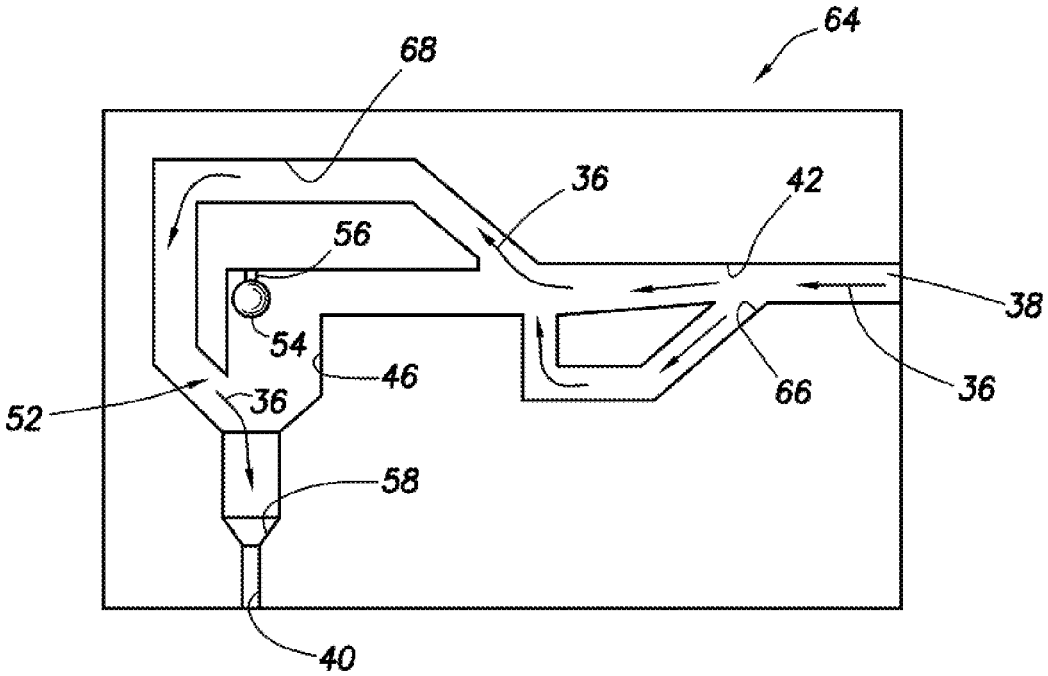
FIGS. 9A & B are schematic plan views of another configuration of the inflow control device.

Referring additionally now to FIGS. 9A & B, another configuration of the inflow control device 64 is representatively illustrated. In this configuration, a bypass passage 66 intersects the flow passage 42 upstream of the chamber 46. The bypass passage 66 is used to bias the fluid composition 36 to flow more toward another bypass passage 68 (which bypasses the chamber 46) when the fluid composition has a relatively high viscosity, low velocity and/or a relatively high ratio of desired to undesired fluid therein, or to flow more toward the chamber 46 when the fluid composition has a relatively low viscosity, high velocity and/or a relatively low ratio of desired to undesired fluid therein.

In FIG. 9A, the fluid composition 36 has a relatively high viscosity, low velocity and/or a relatively high ratio of desired to undesired fluid therein. A significant portion of the fluid composition 36 flows through the bypass passage 66 and impinges on the fluid composition flowing through the passage 42. This causes a substantial portion (preferably a majority) of the fluid composition 36 to flow through the bypass passage 68, and so relatively little of the fluid composition flows through the chamber 46.

Figure 9B:
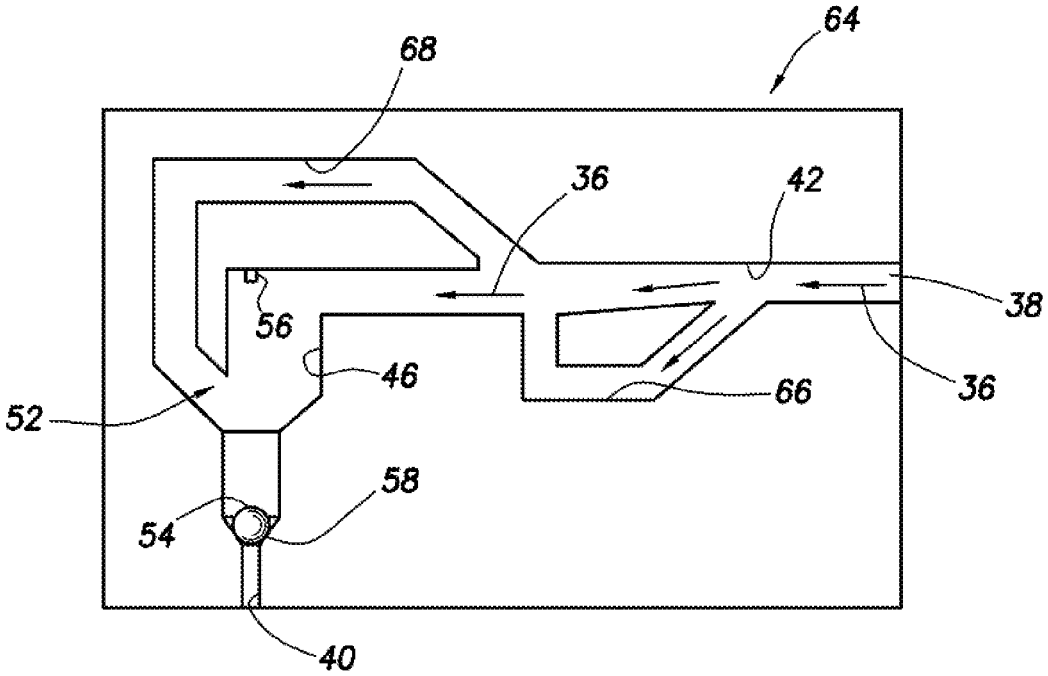

In FIG. 9B, the fluid composition 36 has a relatively low viscosity, high velocity and/or a relatively low ratio of desired to undesired fluid therein. Relatively little of the fluid composition 36 flows through the bypass passage 66, and so the fluid composition is not biased significantly to flow through the other bypass passage 68. As a result, a substantial portion (preferably a majority) of the fluid composition 36 flows through the chamber 46.

It will be appreciated that, with a substantial portion of the fluid composition 36 flowing through the chamber 46, the structure 56 will be more readily eroded or corroded by the fluid composition. In this manner, the relatively low viscosity, high velocity and/or a relatively low ratio of desired to undesired fluid of the fluid composition 36 will cause the structure 56 to degrade and release the plug 54, thereby preventing flow through the outlet 40.

Although in the examples depicted in FIGS. 3A-9B, only a single inlet 44 is used for admitting the fluid composition 36 into the chamber 46, in other examples multiple inlets could be provided, if desired. The fluid composition 36 could flow into the chamber 46 via multiple inlets 44 simultaneously or separately. For example, different inlets 44 could be used for when the fluid composition 36 has corresponding different characteristics (such as different velocities, viscosities, etc.).

Figure 10B:
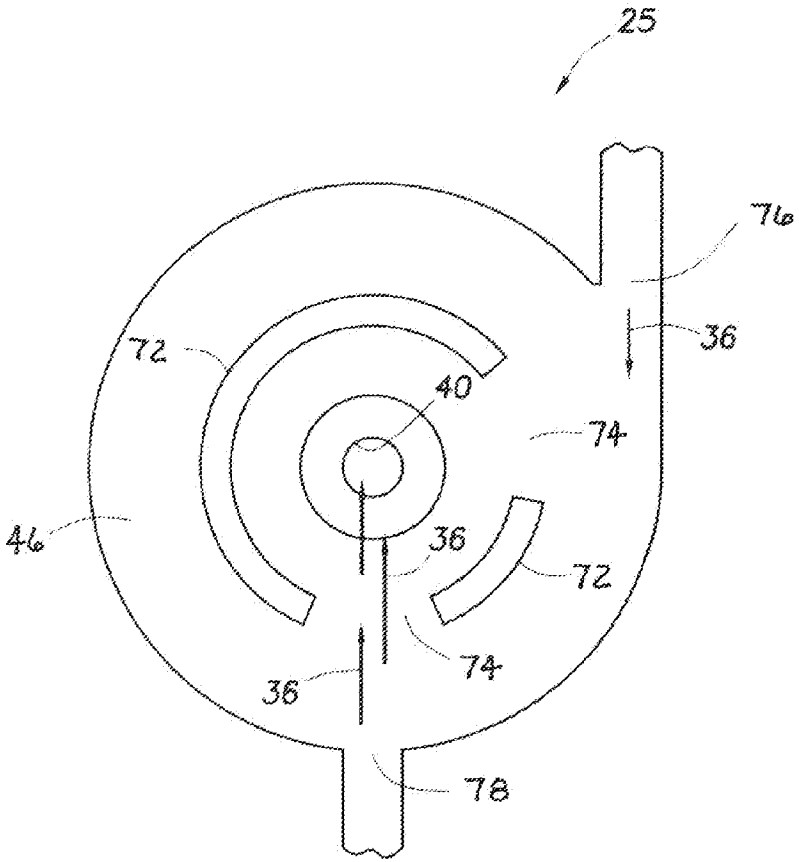
FIGS. 10A & B are schematic plan views of yet another configuration of the inflow control device.
Figure 10A:
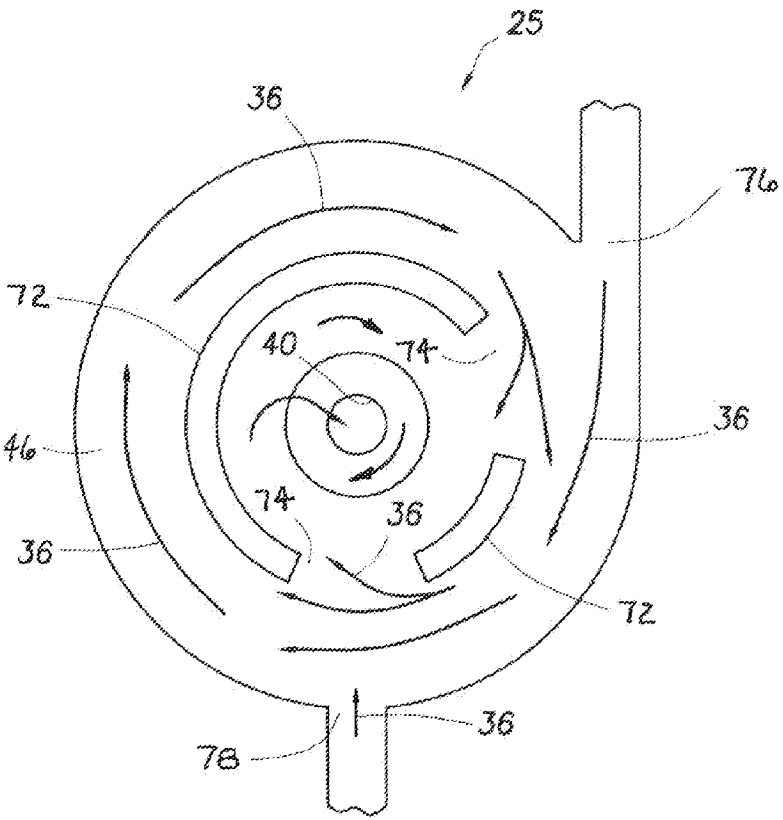

Referring additionally now to FIGS. 10A & B, another configuration of the variable flow resistance system 25 is representatively illustrated. The system 25 of FIGS. 10A & B is similar in many respects to the systems of FIGS. 3A-4B, but differs at least in that one or more structures 72 are included in the chamber 46. As depicted in FIGS. 10A & B, the structure 72 may be considered as a single structure having one or more breaks or openings 74 therein, or as multiple structures separated by the breaks or openings.

Another difference in the configuration of FIGS. 10A & B is that two inlets 76, 78 are provided for flowing the fluid composition 36 into the chamber 46. When the fluid composition 36 has an increased ratio of undesired to desired fluids therein, an increased proportion of the fluid composition flows into the chamber 46 via the inlet 76. When the fluid composition 36 has a decreased ratio of undesired to desired fluids therein, an increased proportion of the fluid composition flows into the chamber 46 via the inlet 78. A similar configuration of inlets to a vortex chamber is described in U.S. patent application Ser. No. 12/792,146, filed on 2 Jun. 2010, the entire disclosure of which is incorporated herein by this reference.

The structure 72 induces any portion of the fluid composition 36 which flows circularly about the chamber 46, and has a relatively high velocity, high density or low viscosity, to continue to flow circularly about the chamber, but at least one of the openings 74 permits more direct flow of the fluid composition from the inlet 78 to the outlet 40. Thus, when the fluid composition 36 enters the other inlet 76, it initially flows circularly in the chamber 46 about the outlet 40, and the structure 72 increasingly resists or impedes a change in direction of the flow of the fluid composition toward the outlet, as the velocity and/or density of the fluid composition increases, and/or as a viscosity of the fluid composition decreases. The openings 74, however, permit the fluid composition 36 to gradually flow spirally inward to the outlet 40.

In FIG. 10A, a relatively high velocity, low viscosity and/or high density fluid composition 36 enters the chamber 46 via the inlet 76. Some of the fluid composition 36 may also enter the chamber 46 via the inlet 78, but in this example, a substantial majority of the fluid composition enters via the inlet 76, thereby flowing tangential to the flow chamber 46 initially (i.e., at an angle of 0 degrees relative to a tangent to the outer circumference of the flow chamber).

Upon entering the chamber 46, the fluid composition 36 initially flows circularly about the outlet 40. For most of its path about the outlet 40, the fluid composition 36 is prevented, or at least impeded, from changing direction and flowing radially toward the outlet by the structure 72. The openings 74 do, however, gradually allow portions of the fluid composition 36 to spiral radially inward toward the outlet 40.

In FIG. 10B, a relatively low velocity, high viscosity and/or low density fluid composition 36 enters the chamber 46 via the inlet 78. Some of the fluid composition 36 may also enter the chamber 46 via the inlet 76, but in this example, a substantial majority of the fluid composition enters via the inlet 78, thereby flowing radially through the flow chamber 46 (i.e., at an angle of 90 degrees relative to a tangent to the outer circumference of the flow chamber).

One of the openings 74 allows the fluid composition 36 to flow more directly from the inlet 78 to the outlet 40. Thus, radial flow of the fluid composition 36 toward the outlet 40 in this example is not resisted or impeded significantly by the structure 72.

If a portion of the relatively low velocity, high viscosity and/or low density fluid composition 36 should flow circularly about the outlet 40 in FIG. 10B, the openings 74 will allow the fluid composition to readily change direction and flow more directly toward the outlet. Indeed, as a viscosity of the fluid composition 36 increases, or as a velocity of the fluid composition decreases, the structures 72 in this situation will increasingly impede the circular flow of the fluid composition 36 about the chamber 46, enabling the fluid composition to more readily change direction and flow through the openings 74.

Note that it is not necessary for multiple openings 74 to be provided in the structure 72, since the fluid composition 36 could flow more directly from the inlet 78 to the outlet 40 via a single opening, and a single opening could also allow flow from the inlet 76 to gradually spiral inwardly toward the outlet. Any number of openings 74 (or other areas of low resistance to radial flow) could be provided in keeping with the principles of this disclosure.

Furthermore, it is not necessary for one of the openings 74 to be positioned directly between the inlet 78 and the outlet 40. The openings 74 in the structure 72 can provide for more direct flow of the fluid composition 36 from the inlet 78 to the outlet 40, even if some circular flow of the fluid composition about the structure is needed for the fluid composition to flow inward through one of the openings.

It will be appreciated that the more circuitous flow of the fluid composition 36 in the FIG. 10A example results in more energy being consumed at the same flow rate and, therefore, more resistance to flow of the fluid composition as compared to the example of FIG. 10B. If oil is a desired fluid, and water and/or gas are undesired fluids, then it will be appreciated that the variable flow resistance system 25 of FIGS. 10A & B will provide less resistance to flow of the fluid composition 36 when it has an increased ratio of desired to undesired fluid therein, and will provide greater resistance to flow when the fluid composition has a decreased ratio of desired to undesired fluid therein.

It will also be appreciated that the fluid composition 36 rotates more about the outlet 40 in the FIG. 10A example, as compared to the FIG. 10B example. Thus, the support structure 56 can more readily be eroded, corroded or otherwise degraded by the flow of the fluid composition 36 in the FIG. 10A example (having an increased ratio of undesired to desired fluids therein), as compared to the FIG. 10B example (having a decreased ratio of undesired to desired fluid in the fluid composition).

Note that it is not necessary for the plug 54 to be rigidly secured by the support structure 56 in any of the configurations of the variable flow resistance system 25 described above. Instead, the support structure 56 could somewhat loosely retain the plug 54 relative to the chamber 46. In such a situation, the loose retention of the plug 54 could allow it to displace (e.g., linearly, rotationally, etc.) somewhat in response to the flow of the fluid composition 36 through the chamber 46.

In the configurations of FIGS. 3A-4B and 10A & B, increased rotational flow of the fluid composition 36 in the chamber 46 due to an increased ratio of undesired to desired fluid in the fluid composition could cause increased rotational displacement of the plug 54 in response. Such increased rotational displacement of the plug 54 can cause increased fatigue, wear, erosion, etc., of the support structure 56 and/or an interface between the plug and the support structure, thereby causing an increased rate of breakage or other degradation of the support structure.

In other examples (such as the example of FIGS. 9A & B), increased vibration, oscillation, etc. of the plug 54 can cause increased fatigue, wear, erosion, etc., of the support structure 56 and/or an interface between the plug and the support structure, thereby causing an increased rate of degradation of the support structure. Thus, an increased ratio of undesired to desired fluids in the fluid composition 36 can lead to quicker breakage or otherwise degrading of the support structure 56.

Although various configurations of the variable flow resistance system 25 and inflow control device 64 have been described above, with each configuration having certain features which are different from the other configurations, it should be clearly understood that those features are not mutually exclusive. Instead, any of the features of any of the configurations of the system 25 and device 64 described above may be used with any of the other configurations.

It may now be fully appreciated that the above disclosure provides a number of advancements to the art of controlling fluid flow in a well. The flow control system 52 can operate automatically, without human intervention required, to shut off flow of a fluid composition 36 having relatively low viscosity, high velocity and/or a relatively low ratio of desired to undesired fluid. These advantages are obtained, even though the system 52 is relatively straightforward in design, easily and economically constructed, and robust in operation.

The above disclosure provides to the art a flow control system 52 for use in a subterranean well. The system 52 can include a flow chamber 46 through which a fluid composition 36 flows, and a plug 54 which is released in response to an increase in a ratio of undesired fluid to desired fluid in the fluid composition 36.

The plug 54 can be released automatically in response to the increase in the ratio of undesired to desired fluid. The increase in the ratio of undesired to desired fluid may cause degradation, breakage, erosion and/or corrosion of a structure 56 which supports the plug 54.

The plug 54, when released, may prevent flow through the flow chamber 46, or prevent flow from an inlet 38 to an outlet 40 of the flow chamber 46.

The increase in the ratio of undesired to desired fluid in the fluid composition 36 can result from an increase in water or gas in the fluid composition 36.

The increase in the ratio of undesired to desired fluid in the fluid composition 36 can result in an increase in a velocity of the fluid composition 36 in the flow chamber 46.

Also described above is a flow control system 52 which includes a flow chamber 46 through which a fluid composition 36 flows, a plug 54, and a structure 56 which supports the plug 54, but which releases the plug 54 in response to degrading of the structure 56 by the fluid composition 36.

The structure 56 may be degraded in response to an increase in a ratio of undesired fluid to desired fluid in the fluid composition 36.

The plug 54 may be released automatically in response to the degrading of the structure 56.

An increase in a ratio of undesired fluid to desired fluid in the fluid composition 36 can cause degradation, breakage, erosion and/or corrosion of the structure 56.

The plug 54, when released, may prevent flow from an outlet 40 of the flow chamber 46.

The degrading of the structure 56 may result from an increase in water in the fluid composition 36 and/or from an increase in a velocity of the fluid composition 36 in the flow chamber 46.

Another flow control system 52 described above can include a flow chamber 46 through which a fluid composition 36 flows, and a plug 54 which is released in response to an increase in a velocity of the fluid composition 36 in the flow chamber 46.

The plug 54 can be released automatically in response to the increase in the velocity of the fluid composition 36. The increase in velocity of the fluid composition 36 may cause degradation, breakage, erosion and/or corrosion of a structure 56 which supports the plug 54.

The increase in velocity of the fluid composition 36 may result from an increase in water and/or gas in the fluid composition 36, and/or from an increase in a ratio of undesired fluid to desired fluid in the fluid composition 36.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A flow control system for use in a subterranean well, the system comprising:

a flow chamber through which a fluid composition flows; and a plug supported by a support structure, wherein the support structure comprises a material which degrades via at least one of corrosion and erosion, thereby releasing the plug from the support structure into the flow chamber, wherein rotational movement of the plug relative to the support structure increases in response to an increase in a ratio of undesired fluid to desired fluid in the fluid composition, and wherein the increased rotational movement of the plug increases a rate of degradation of the support structure.

2. The system of claim 1, wherein the plug is released automatically in response to the increase in the ratio of undesired to desired fluid.

3. The system of claim 1, wherein the increase in the ratio of undesired to desired fluid causes the degradation of the support structure.

4. The system of claim 1, wherein the increase in the ratio of undesired to desired fluid causes the corrosion of the support structure.

5. The system of claim 1, wherein the increase in the ratio of undesired to desired fluid causes the erosion of the support structure.

6. The system of claim 1, wherein the plug, when released, prevents flow through the flow chamber.

7. The system of claim 1, wherein the plug, when released, prevents flow from an inlet to an outlet of the flow chamber.

8. The system of claim 1, wherein the increase in the ratio of undesired to desired fluid in the fluid composition results from an increase in water in the fluid composition.

9. The system of claim 1, wherein the increase in the ratio of undesired to desired fluid in the fluid composition results in an increase in a velocity of the fluid composition in the flow chamber.

10. The system of claim 1, wherein the increase in the ratio of undesired to desired fluid in the fluid composition results from an increase in gas in the fluid composition.

11. A flow control system for use in a subterranean well, the system comprising:

a flow passage through which a fluid composition flows;

a flow chamber;

a bypass passage;

a plug comprising a ball; and a structure which supports the plug, but which releases the plug in response to degrading of the structure by the fluid composition, wherein an amount of the fluid composition that flows through the bypass passage decreases in response to an increase in a ratio of undesired fluid to desired fluid in the fluid composition, and an amount of the fluid composition that flows through the flow chamber increases in response to the increase in the ratio, and wherein a rate of degradation of the structure is increased in response to the increased flow through the flow chamber.

12. The system of claim 11, wherein the plug is released automatically in response to the degrading of the structure.

13. The system of claim 11, wherein the degradation includes erosion of the structure.

14. The system of claim 11, wherein the degradation includes corrosion of the structure.

15. The system of claim 11, wherein the degradation causes breakage of the structure.

16. The system of claim 11, wherein the plug, when released, prevents flow through the flow chamber.

17. The system of claim 11, wherein the plug, when released, prevents flow through the flow chamber and the bypass passage.

18. The system of claim 11, wherein the degrading of the structure results from an increase in water in the fluid composition.

19. The system of claim 11, wherein the degrading of the structure results from an increase in a velocity of the fluid composition in the flow passage.

20. The system of claim 11, wherein the degrading of the structure results from an increase in gas in the fluid composition.

21. A flow control system for use in a subterranean well, the system comprising:

a vortex chamber through which a fluid composition flows from an earth formation into an interior of a tubular string; and a plug which is released from a support structure in response to an increase in a rotational velocity of the fluid composition in the vortex chamber, wherein the increase in the rotational velocity of the fluid composition results from an increase in a ratio of undesired fluid to desired fluid in the fluid composition, and wherein the increase in rotational velocity of the fluid composition increases a rate of degradation of the support structure.

22. The system of claim 21, wherein the plug is released automatically in response to the increase in the rotational velocity of the fluid composition.

23. The system of claim 21, wherein the degradation includes erosion of the support structure.

24. The system of claim 21, wherein the degradation includes corrosion of the support structure.

25. The system of claim 21, wherein the degradation includes breakage of the support structure.

26. The system of claim 21, wherein the plug, when released, prevents flow through the vortex chamber.

27. The system of claim 21, wherein the plug, when released, prevents flow from an inlet to an outlet of the vortex chamber.

28. The system of claim 21, wherein the increase in the ratio of undesired fluid to desired fluid in the fluid composition results from an increase in water in the fluid composition.

29. The system of claim 21, wherein the increase in the ratio of undesired fluid to desired fluid in the fluid composition results from an increase in gas in the fluid composition.

* * * * *